United States Patent [19]

Gueret

[11] Patent Number: 5,009,534

[45] Date of Patent: Apr. 23, 1991

[54] PISTON DISPENSER FOR PASTE OR SOLID PRODUCTS

[75] Inventor: Jean-Louis Gueret, Paris, France

[73] Assignee: L'Oreal, Paris, France

[21] Appl. No.: 474,525

[22] Filed: Feb. 2, 1990

[30] Foreign Application Priority Data

Feb. 7, 1989 [FR] France ..... 89 01545

[51] Int. Cl.[5] ..... B05C 17/00; B45D 40/06

[52] U.S. Cl. ..... 401/75; 401/175; 401/68

[58] Field of Search ..... 401/75, 64, 174, 70, 401/116, 172, 73, 68

[56] References Cited

U.S. PATENT DOCUMENTS

| | | | |
|---|---|---|---|
| 2,336,328 | 12/1943 | Whalen | 401/75 X |
| 2,559,889 | 7/1951 | Mathews | 401/75 |
| 3,106,908 | 10/1963 | Gretz | 401/70 X |
| 3,232,276 | 2/1966 | Kupersmith | 401/75 X |
| 3,256,980 | 6/1966 | Bau | 401/75 |
| 3,358,699 | 12/1967 | Bau | 401/70 |
| 4,664,547 | 7/1985 | Rosenwinkel | 401/175 |

FOREIGN PATENT DOCUMENTS

| | | | |
|---|---|---|---|
| 3728427 | 12/1988 | Fed. Rep. of Germany | 401/75 |
| 1045189 | 6/1953 | France | 401/174 |
| 1193220 | 3/1958 | France . | |
| 1351560 | 12/1963 | France | 401/75 |
| 1458448 | 9/1965 | France . | |
| 2228452 | 5/1974 | France . | |
| 2476020 | 11/1980 | France . | |
| 635724 | 4/1950 | United Kingdom | 401/174 |
| 2144374 | 7/1984 | United Kingdom . | |
| 2150424 | 11/1984 | United Kingdom . | |
| 8601085 | 8/1985 | World Int. Prop. O. . | |

*Primary Examiner*—Richard J. Johnson

*Attorney, Agent, or Firm*—Cushman, Darby & Cushman

[57] ABSTRACT

The dispenser of a solid or paste product to be spread includes a reservoir (1) containing the product (P), which is made available by a drive mechanism manually controlled by the user, the reservoir (1) being a tube the interior of which is cylindrical, the tube including a dispensing opening (4), and a product (P) being disposed in the tube between the dispensing opening (4) and a displaceable piston (5), the translation of the piston (5) being obtained by means of the drive mechanism, the drive mechanism including a rod (6) at the end of which the piston (5) is engaged, the piston (5) being pierced, from its face (10) closest to the product (P) to its face facing the drive mechanism, by at least one conduit (11). The edge of the dispensing opening (4) are at least partly covered with a layer of an air-permeable material that serves to apply the product (P), the layer (8) being positioned over the edge.

14 Claims, 2 Drawing Sheets

PISTON DISPENSER FOR PASTE OR SOLID PRODUCTS

FIELD OF THE INVENTION

The present invention relates to a dispenser for a paste or solid product, such as a cosmetic product to be spread on the skin. In particular, this dispenser is of the type including a reservoir and a piston that is slowly translatable forward within the reservoir, for ejecting the product from it, by means of a manually controlled drive mechanism. The dispenser may also be suitably used for molded products such as lipstick, extruded products such as makeup base, or compacted products such as eyeshadow.

BACKGROUND OF THE INVENTION

Dispensers of this kind are already known and have been available to consumers for a long time. The piston that drives the product to be ejected translationally is generally mounted at the end of a threaded rod that cooperates with a nut integrally attached to the dispenser. The rod is in turn driven to rotate incrementally via a pushbutton actuated by the user (see U.S. Pat. No. 4,624,594, for example and U.S. Pat. No. 4,954,000, Granted Sept. 4, 1990.

Filling such a dispenser presents practical problems at the present time. The part of the dispenser including the drive mechanism has a relatively high production cost. To prevent improper handling during filling from making the dispenser unusable and hence unsaleable, it is generally kept separate from the reservoir portion at the moment it is filled. The two parts of the dispenser are then assembled later. It is in this assembly that the difficulty arises, particularly when the piston carried by the rod must be threaded into the tube of the reservoir. When the piston engages the rear end of the reservoir, the layer of air between the end of the product and the face of the piston facing the product is trapped. To expel this layer of air from the reservoir through the spaces existing between the piston and the wall of the reservoir, major effort must be exerted on the piston, with the risk of damaging the dispenser and crushing the product. Moreover, if a layer of air remains between the product and the piston, the action of the piston will necessarily be damped, and its response to manual actions by the user will be altered. Moreover, in the case of a cosmetic product, contact with the trapped air tends to alter the product.

SUMMARY OF THE INVENTION

The present invention proposes a device making it possible to overcome these disadvantages. In particular, it proposes using a piston that is a separate piece from the screw with which it cooperates and that is pierced by a conduit, enabling evacuation of the air between the product and the piston at the moment of assembly. Once the product is in place in the reservoir, the piston is threaded into the tube of the reservoir as far as the product; air between the product and the piston escapes through this conduit. Thus the piston directly engages the product. The part of the dispenser including the drive mechanism can then be placed on the reservoir. If the reservoir is not interchangeable, the drive mechanism may be incapable of being disengaged. In that case, the rod is initially in the position of maximum retraction, and it is put in contact with the piston by actuating the drive mechanism several times to start the dispensing. However, if the reservoir is indeed interchangeable, then the rod must be capable of being disengaged from the drive mechanism, because once the dispensing to a reservoir is completed, the rod is in a position of maximum projection and must be capable of returning to the vicinity of its position of maximum retraction for the new reservoir. In such a case, when a new reservoir is being put in place, the rod moves backward by pressing against the piston contained in the reservoir, until the reservoir has been affixed; as a result, dispensing can begin without any starting maneuver, since the rod is in contact with the piston by the placement of the new reservoir in the same place.

Hence the subject of the invention is a dispenser of a solid or paste product to be spread which is contained in a reservoir and is made available by a drive mechanism manually controlled by the user, the reservoir being a tube having a cylindrical interior and an arbitrary cross section; the tube includes a dispensing opening, and a product is disposed in the tube between the dispensing opening and a displaceable, slowfeed piston. The translation of the piston is obtained by means of the drive mechanism, which includes a rod at the end of which the piston is attached, and the piston is pierced, from its face closest to the product to its face facing elements of the drive mechanism, by at least one conduit.

Advantageously, a conduit is located in the axial extension of the rod; that the piston and the rod are two separate pieces, the head of the rod pressing on a surface of the piston into which the conduit opens in order to push the piston translationally. The end of the rod head has a center punch with a substantially conically shaped free end, and the surface of the piston with which it cooperates has a conical shape corresponding to that of the end of the center punch. The surface of the substantially conically shaped piston is extended via a guide bore. In the vicinity of its end that is attached to the rod, the center punch may include a plate perpendicular to the axis of the rod.

Preferably, the peripheral wall of the piston is provided with at least one annular lip in contact, with slight squeezing, with the inner wall of the reservoir. The piston may include at least one annular lip in the vicinity of each of its end faces.

Advantageously, the edges of the dispensing opening are at least partially covered with a layer that serves to apply the product and is made of an air-permeable material, the layer being positioned straddling the edges. This material may be porous and spongy. This application layer may be a flock or a synthetic foam with open or closed pores. If it is a flock, then it may be glued or deposited electrostatically onto the edges of the dispensing opening. The flock may be of the conventional type, namely, very short fibers of wool, cotton or the like, to provide a soft protective covering on the edges of the dispensing opening.

Preferably, the edge of the dispensing opening is disposed obliquely with respect to the axis of the reservoir. The reservoir is nested inside a tubular joining piece with which it is associated, its outer wall and the inner wall of the joining piece each being provided with a helical ramp, the helical ramps cooperating to keep the reservoir in a predetermined angular position with respect to the joining piece. The reservoir is detachable with respect to the drive mechanism, and the rod can be disengaged from the drive mechanism at the moment when the reservoir is attached to the drive mechanism.

The rod is a screw driven in rotation by the drive mechanism and cooperating with a nut that is fixed with respect to the joining piece, and the nut is slit along a generatrix; the end of the reservoir opposite the dispensing opening of the reservoir is nested onto the outer walls of the nut by conical seating.

The subject of the invention will be better understood from the ensuing purely illustrative, non-limiting description of an exemplary embodiment, shown in the accompanying drawings.

DESCRIPTION OF THE PREFERRED EMBODIMENT

Figure 1:
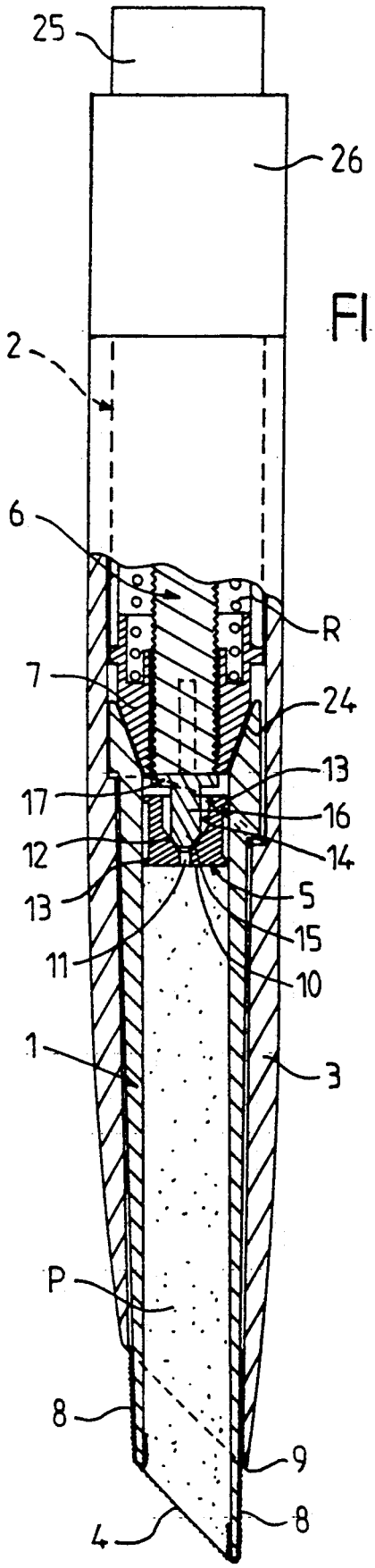
FIG. 1 is an elevational view, partly in section, of a dispenser according to the invention.

Turning to the drawing, the dispenser is seen to include a reservoir 1 mounted on a part 2 that includes the drive mechanism of the dispenser. These two parts of the dispenser are nested together and kept in place in a tubular connector 3 that forms a sheath comprising the body of the dispenser. By screwing or interlocking, the sheath 3 is fixed to a shoulder 26 that is solidly attached to the drive mechanism.

The reservoir 1 is a tube, the interior of which, intended to contain a product P comprising a paste or a compacted powder, is a straight cylinder of right circular cross section. One of its ends is a dispensing opening 4. At its other end is located the piston 5 which contacts the product P and cooperates with the end of a screw rod 6. The thread of this screw rod 6 cooperates with the thread of a nut 7 of the drive mechanism 2 in order to drive the piston 5 translationally along the axis of the reservoir 1. The dispensing opening 4 of the reservoir 1 is oblique with respect to the axis of the reservoir, with an inclination of 60° with respect to a plane orthogonal to the axis of the reservoir. The outer face of the wall of the reservoir 1 is slightly frustoconical. This outer wall fits together with the inner wall of the tubular connector or sheath 3, in which it is nested; part of the reservoir 1, toward the dispensing opening 4, projects from the sheath 3. The end 9 of the sheath 3 closest to the opening 4 is also oblique with respect to the axis of the reservoir 1 and is parallel to the plane in which the opening 4 is located. The wall of the sheath 3 thickens, beginning at the end 9 and extending to approximately the middle of the reservoir 1.

The edges of the dispensing opening 4 are coated with a layer of flock 8. This layer of flock 8 is positioned straddling the edges of the opening 4, and the surface area of the flock 8 on the inside of the reservoir 1 at 8' is less than that of the flock on the outside of the reservoir 1. The thickness of this layer of flock 8 is less than 30% of the thickness of the edge of the dispensing opening 4. The end of the flock 8 farthest from the opening 4, on the outer surface of the reservoir 1, is positioned on a circle in a plane orthogonal to the axis of the reservoir 1. To prevent contamination of the product, the flocking 8,8' is provided before the reservoir is filled, by depositing fibers on the walls of the reservoir electrostatically or with glue. To obtain precise flocking inside the reservoir 1, a mandrel (not shown) that is threaded on the inside and substantially fits to its inner wall of reservoir 1 is used. The end of this mandrel closer to the opening 4 is offset slightly in the reservoir 1 from the edges of the opening 4, such that the flock 8 can be deposited on the inner wall of the reservoir 1; the surface area deposited is defined perfectly by the level of the mandrel. In a variant, the flock may be replaced with a synthetic foam, for example expanded "in situ".

The piston 5 is an element of revolution. One of its faces is a plate 10 in contact with the product P. This plate 10 is pierced by an axially centered conduit 11 which expands in the piston 5 past the plate 10 to form a conical recess 12 made in the body of the piston 5. The conical recess 12 is in turn prolonged axially by a bore 14, which discharges at the other face of the piston 5. Each of the end faces of the piston 5 is surrounded on its periphery by an annular lip 13 intended to be in contact, with slight squeezing, with the inner wall of the reservoir 1. The head of the screw 6 has a center punch 16, one conical end 15 of which is intended to cooperate with the conical recess 12 of the piston 5. The center punch 16 is a cylindrical body, the diameter of which is slightly less than that of the bore 14; it nests in place by sliding inside the bore 14, At its end opposite the conical portion 15, the center punch 16 includes a plate 17, which is a disk resting on the rod 6; this disk has a diameter larger than the diameters-of the rod 6 and the cylindrical body of the center punch 16.

Figure 5:
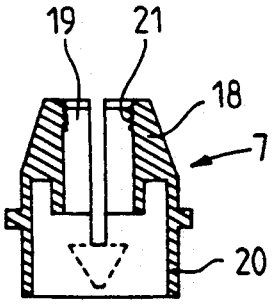
FIG. 5 is a sectional view along the line V—V of FIG. 6 of the nut of the dispenser of FIG. 1.
Figure 6:
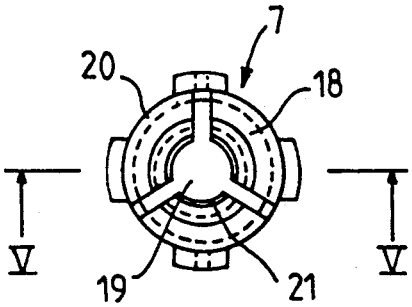
FIG. 6 is an end view of the nut of the dispenser of FIG. 1.

The nut 7 is a split nut ( FIG. 5), including three sectors 18 distributed symmetrically about the axis of the nut 7. These three sectors 18 are connected to one another at one of their ends by a cylindrical skirt 20 that extends their peripheral walls. Their ends opposite this skirt 20 form the frustoconical head of the nut, which defines an axial bore 19 having substantially the same diameter as the screw rod 6 which is disposed inside it. The bore 19 is threaded at its end opposite the skirt 20. The thread 21 is intended for cooperation with the thread of the screw rod 6. On its end opposite the dispensing opening 4, the inside wall of the reservoir 1 is provided with a bearing surface 24 shaped frustoconically to adapt to the head of the nut 7.

The sheath 3 of the distributor and the reservoir 1 are each provided with a helical ramp 22, 23 toward the end of the reservoir 1 opposite the dispensing opening 4; the ramp 22 is disposed on the outer wall of the reservoir 1 and the ramp 23 on the inner wall of the sheath 3. Each of these two ramps 22 and 23 comprises a setback from the wall on which each of the ramps is disposed. As a result, at the level of the ramp 22, the wall of the reservoir 1 is thinner on the side toward the dispensing opening 4 than on the other side toward the ramp 22. The wall of the sheath 3 is thicker at the level of the ramp 23 in its part closer to the open end 9 than on the other side with respect to the ramp 23. These two ramps 22 and 23 are intended to cooperate and they enable the angular positioning of the reservoir 1 and sheath 3 such that their openings 4 and 9 are parallel. In the assembled position, the reservoir 1 rests with its frustoconical bearing 24 on the sectors 18 comprising the head of the nut 7, and its ramp 22 rests on the ramp 23 of the sheath. The fixation of the sheath 3 on the shoulder 26 thus makes it possible to maintain the reservoir 1 in position and to maintain its action on the nut 7 in order to close the sectors 18 around the screw 6.

The reservoir 1, sheath 3, piston 3 and nut 7 are parts that are molded from plastic material. After these various pieces have been made, initially, the filling of the reservoir 1 is accomplished and, then separately, the assembly of the parts of the portion 2 including the drive mechanism is done. Such a drive mechanism may be of the type described in U.S. Pat. No. 4,954,000 of the present applicant; in particular, it includes a spring R and a pushbutton 25 mounted on the end of the shoulder 26 located farthest from the reservoir 1; depressing the pushbutton 25 makes it possible to control the translation of the piston 5, and the spring R assures the return of the pushbutton. Subsequently, the reservoir 1 is mounted on the portion 2 that includes the drive mechanism, by nesting the assembly in the sheath 3. The end of the drive device opposite the nut 7 is solidly attached to the shoulder 26, onto which the end of the sheath 3 is fixed. This shoulder 26 is screwed onto an internal thread 27 with which the corresponding end of the sheath 3 is provided. In one possible variant, the fixation is done by latching.

Figure 2:
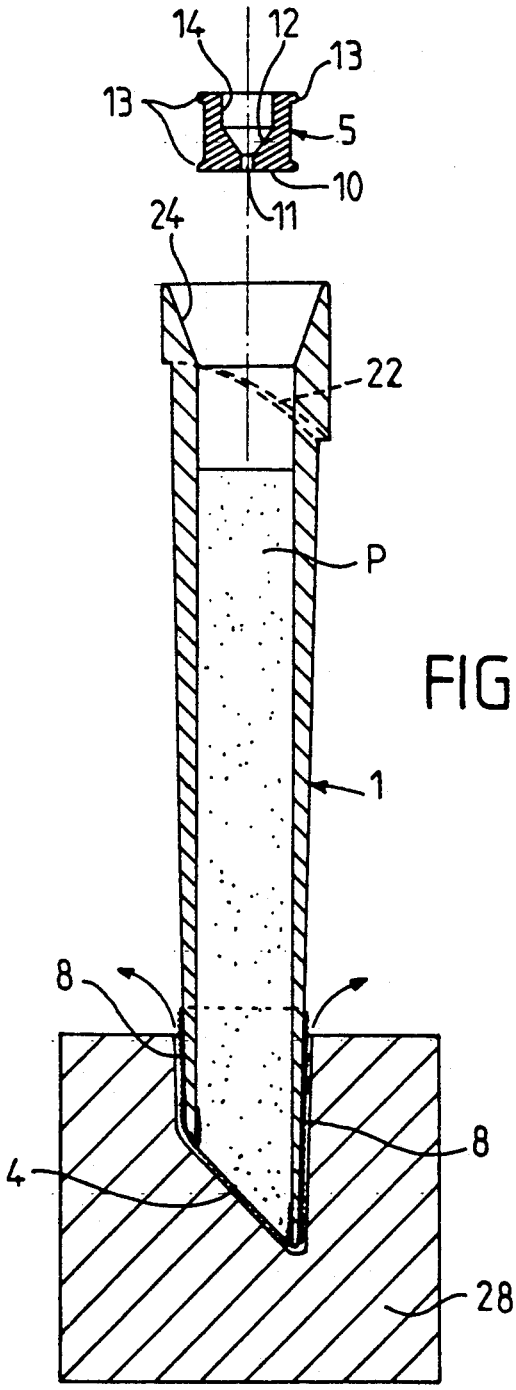
FIG. 2 is a sectional view of the reservoir and piston of the dispenser of FIG. 1, the reservoir being fitted in a support, in the position for filling.
Figure 3:
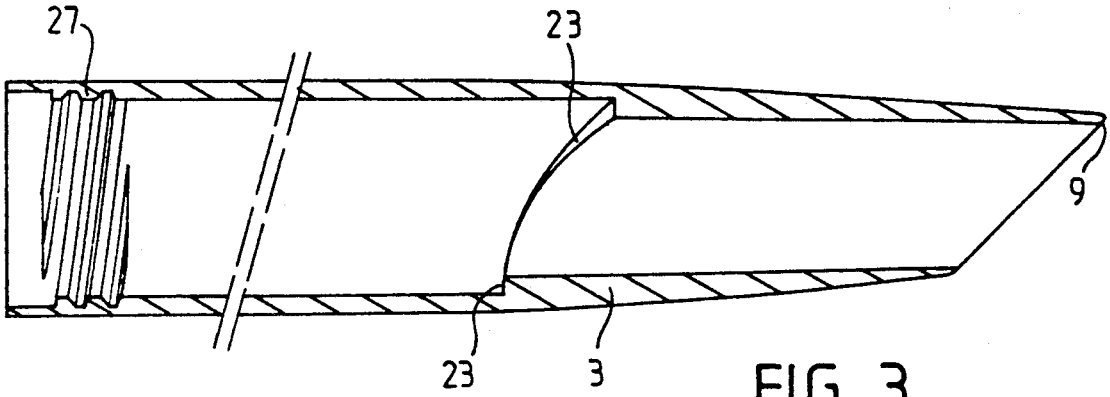
FIG. 3 is a sectional view of the tubular joining piece of the dispenser of FIG. 1.
Figure 4:
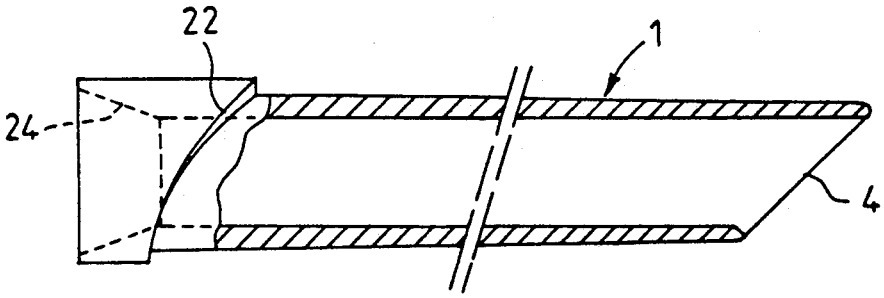
FIG. 4 is an elevation view, partly in section, of an unfilled reservoir intended for the dispenser of FIG. 1.

For either molding, extruding or compacting a product in the reservoir, the device of FIG. 2 is used to fill the reservoir 1. The reservoir 1 is held vertically in as bore made in a support 28; the dispensing opening 4 is encased in this bore, and the conical bearing 24 opens upward. The bottom of the bore of the support 28 is an inclined plane on which the edges of the dispensing opening 4 rest. Its side wall fits against the flock 8 and squeezes it against the edges of the dispensing opening 4. The reservoir 1 and the support 28 thus together form a container having a bottom and capable of holding liquid or solid substances, and in which a product such as lipstick can be molded. If it is desired to extrude or compact a product here, then the product P is introduced via the end of the reservoir 1 opposite the dispensing opening 4, and for the compacting the product is compressed by threading a compressor piston into the interior of the reservoir. In both cases, the air driven back toward the bottom of the container is evacuated as a result of the flock 8, which is air-permeable, as the arrows in FIG. 2 indicate. Thus the product P can be emplaced without any flaw at the opening 4.

Next, on the end opposite the dispensing opening 4, the piston 5 is threaded on, with its plate 10 being directly face-to-face with the product P. The piston 5 slides in the interior cylinder of the reservoir 1 until its plate 10 is in contact with the product P, regardless of the level to which the product P has been filled in the reservoir; the air located between the plate 10 and the product P escapes via the conduit 11. Next, the screw 6 is positioned such that the conical portion 15 of its center punch 16 is fitted into the conical recess 12 of the piston 5, after having been guided in the cylindrical bore 14. Finally, the assembly formed by the shoulder 26 and the portion 2 of the dispenser, which includes the drive mechanism, is fastened by threading the screw 6 into the bore 19 until the sectors 8 forming the conical head of the nut 7 rest on the frustoconical bearing 24 of the reservoir 1, thus closing the thread 21 of the bore 19 again on the thread of the screw 6. Once the assembly has been put in place, it remains to nest the reservoir 1 and the portion 2 into the sheath 3 and to assure the fixation of the sheath 3 on the shoulder 26.

The assembly is now finished and ready to be used. By actuating the push button 25, the user releases a fine layer of product P from the reservoir 1, which is applied to the desired region by spreading it onto the layer of flock 8, which thus serves as an applicator pad and presents the product P from soiling the edges of the reservoir 1. If the product P is furthermore a cosmetic product intended to be applied to the skin, then the layer of flock 8 has the further advantage of making the contact between the skin and the dispenser more gentle. Once it has been spread, the product P is located substantially just below the rounded end of the flock 8 at the edges of the dispensing opening 4, but above the end of the wall of the reservoir 1. A stopper (not shown) making it possible to prevent the product P from drying out or deteriorating can also be associated with the dispensing opening 4.

Finally, in the case where the sheath has been screwed onto the shoulder 26, then when the product P in the reservoir 1 has been used up completely and is to be replaced, the shoulder 26 can be unscrewed and the portion 2 including the drive mechanism can be disengaged from the sheath 3. The sectors -18 of the nut 7 are no longer in contact with the bearing 24 of the reservoir 1, and the thread 21 of the bore 19 no longer cooperates with the thread of the screw 6, so that the screw can be made to slide freely in the bore 19, while the plate 17 of the head of the screw 6 nevertheless comprises a travel limitation. Hence it is possible to replace a reservoir 1 t-hat has been more or less used up with a different reservoir 1. Such an arrangement thus makes it possible to use a plurality of reservoirs 1 as refills, with the same portion 2 serving as a drive mechanism.

What is claimed is:

1. A dispenser for a product to be spread and including a reservoir for the product, a drive means for dispensing the product from said reservoir, said reservoir comprising a tube having a cylindrical interior and a dispensing opening at one end thereof, a piston movably disposed in said interior of said tube, said drive means including a rod having one end engageable with said piston, said piston having opposite faces and a passage extending therethrough from the one of said faces facing said reservoir to the other of said faces facing said rod, said passage being located in said piston so as to be in axial alignment with said rod and said rod having a head for engaging said other of said faces of said piston on which said passage opens, said rod being movable toward said piston to bring said head into engagement therewith to effect the dispensing and away from said piston thereby allowing separation of said rod from said piston.

2. The invention as claimed in claim 1 wherein said other of said faces of said piston includes a conically shaped recess and said head of said rod comprising a center punch having a free end that is conically shaped to cooperate with said recess of said piston.

3. The invention as claimed in claim 2 wherein said recess of said piston includes a bore opening on said other of said faces.

4. The invention as claimed in claim 1 wherein said dispensing opening has an edge disposed obliquely with respect to the axis of the reservoir.

5. The invention as claimed in claim 1 wherein said piston includes a peripheral wall provided with at least one annular lip that is in contact, with slight squeezing, with the inner wall of the said reservoir.

6. The invention as claimed in claim 5 wherein said peripheral wall includes a pair of end faces each having a said annular lip.

7. The invention as claimed in claim 1 wherein said dispensing opening of said tube is at least partially covered with a layer of a air-permeable material.

8. The invention as claimed in claim 7 wherein said material of said layer is porous and spongy.

9. The invention as claimed in claim 7 wherein said material comprises an applied flock having pores.

10. The invention as claimed in claim 9, wherein the dispensing opening has edge surfaces and the flock is glued onto the edge surfaces of the dispensing opening.

11. The invention as claimed in claim 9 wherein the dispensing opening has edge surfaces and the flock is deposited electrostatically onto said edge surfaces.

12. A dispenser for a product to be spread and including a reservoir for the product, a drive means for dispensing the product from said reservoir, air reservoir comprising a tube having a cylindrical interior and a dispensing opening at one end thereof, a piston movably disposed in said interior of said tube, said drive means including a rod having one end engageable with said piston, said piston having opposite faces and a passage extending therethrough from the one of said faces facing said reservoir to the other of said faces facing said rod, said passage being located in said piston so as to be in axial alignment with said rod and said rod having a head for engaging said other of said facers of said piston on which said passage opens, said other of said faces of said piston including a conically shaped recess and said head of said rod comprising a center punch having a free end that is conically shaped to cooperate with said recess of said piston, said recess of said piston including a bore opening on said other of said faces, said head of said rod including a flat plate and said rod having a flat end with said flat plate engaging said flat end.

13. A dispenser for a product to be spread and including a reservoir for the product, a drive means for dispensing the product from said reservoir, said reservoir comprising a tube having a cylindrical interior and a dispensing opening at one end thereof, a piston movably disposed in said interior of said tube, said drive means including a rod having one end engageable with said piston, said piston having opposite faces and a passage extending therethrough from the one of said faces facing said reservoir to the other of said faces facing said rod, said passage being located in said piston so as to be in axial alignment with said rod and said rod having a head for engaging said other of said faces of said piston on which said passage opens, said tube being nested within a tubular joining member, said tube having an outer wall and said joining member having an inner wall with said inner and outer walls having interengaging helically extending ramps for maintaining said reservoir and said tubular joining member in predetermined relative positions to one another.

14. A dispenser for a product to be spread and including a reservoir for the product, a drive means for dispensing the product from said reservoir, said reservoir comprising a tube having a cylindrical interior and a dispensing opening at one end thereof, a piston movably disposed in said interior of said tube, said drive means including a rod having one end engageable with said piston, said piston having opposite faces and a passage extending therethrough form the one of said faces facing said reservoir to the other of said faces facing said rod, said passage being located in said piston so as to be in axial alignment with said rod and said rod having a head for engaging said other of said faces of said piston on which said passage opens, said reservoir being detachable from said drive means and said rod being detachable from wide drive means, said drive means including a split nut having a threaded portion and said rod being threaded along at least a portion of its length with said threaded portion of si nut receiving said threaded rod, said tube of said reservoir having a conically shaped end opposite said dispensing end and said nut having a conical exterior for nesting in said conically shaped end of said tube.

* * * * *